US005255992A

United States Patent [19]

Nickow

[11] Patent Number: 5,255,992

[45] Date of Patent: Oct. 26, 1993

[54] TWO PIECE EXPANDABLE LOOSE LEAF BINDER

[75] Inventor: Glenn Nickow, Winnetka, Ill.

[73] Assignee: General Loose Leaf Bindery Co., Inc., Waukegan, Ill.

[21] Appl. No.: 6,792

[22] Filed: Jan. 21, 1993

[51] Int. Cl.[5] ..... B12F 13/00

[52] U.S. Cl. ..... 402/74; 402/73

[58] Field of Search ..... 402/17, 73, 74, 18, 402/70

[56] References Cited

U.S. PATENT DOCUMENTS

| | | | |
|---|---|---|---|
| Re. 11,846 | 8/1900 | Gilson | 402/74 |
| 1,653,448 | 12/1927 | Eburne | 402/74 |
| 3,026,876 | 3/1962 | Peynado . | |
| 3,362,412 | 1/1968 | Moller . | |
| 3,435,828 | 4/1969 | Miller . | |
| 3,612,708 | 10/1971 | Grundell . | |
| 3,791,747 | 2/1974 | Grundell . | |
| 4,229,022 | 10/1980 | Grundell . | |
| 4,302,123 | 11/1981 | Dengler et al. | 402/17 X |

*Primary Examiner*—Mark Rosenbaum
*Assistant Examiner*—Willmon Fridie, Jr.
*Attorney, Agent, or Firm*—Edward D. Gilhooly, Ltd.

[57] ABSTRACT

A expandable loose leaf binder having a rigid front cover and a rigid back cover. A flexible flap being affixed to the back cover and having two rows of apertures extending from an edge of the back cover. The sheets are retained by post members extending through the front and back covers and a selected pair of apertures in the flap.

7 Claims, 1 Drawing Sheet

TWO PIECE EXPANDABLE LOOSE LEAF BINDER

BACKGROUND OF THE INVENTION

1. Field of the Invention

This invention relates to loose leaf binders and more particularly, to an expandable loose leaf binder having a two piece configuration.

2. Summary of the Prior Art

As has been long known, it is more convenient and efficient to secure the plurality of loose sheets of paper and the like in a binder. The sheets being bound in a loose leaf type arrangement can constitute paper, plastic, and the like of many forms, such as, for example, the sheets of a computer printout. In the past binders for securing loose leaf sheets have constituted a multitude of designs which suffer from several shortcomings. For example, several binder configurations employ a fixed width such that its thickness is virtually the same whether a few sheets are present or a large number are being bound. In addition, known designs of binders are cumbersome to be expanded as traditional sheets are added. Attempts have been made to improve binders so that they are expandable to accommodate various numbers of sheets or to permit the addition of removal of sheets as needed. Known variable thickness binders are inconvenient to use and have not provided a finished look in any sheet capacity. Accordingly, it is desirable to provide an improved variable capacity binder that is easy to use and can accommodate a large number of sheets in an attractive manner.

SUMMARY OF THE INVENTION

It is therefore an objective of the invention to provide a two piece adjustable binder providing ease of attachment with an economical design. The expandable binder herein disclosed includes a back cover having a flap provided with a plurality of apertures to accommodate variable thicknesses of sheets being secured and providing an attractive covered edge. One embodiment of the binder of the invention can secure up to fifteen hundred sheets and is expandable from one inch to six inches. In all thicknesses of the binder, it has a finished look covering the back edges of all the sheets being secured.

DESCRIPTION OF THE PREFERRED EMBODIMENT

Figure 1:
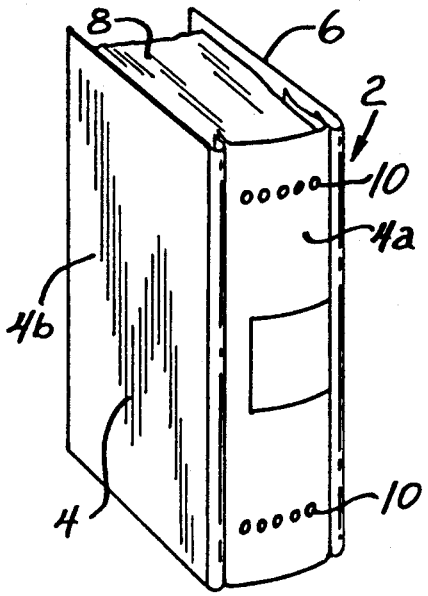
FIG. 1 is a back perspective view of the expandable loose leaf binder of the invention.
Figure 2:
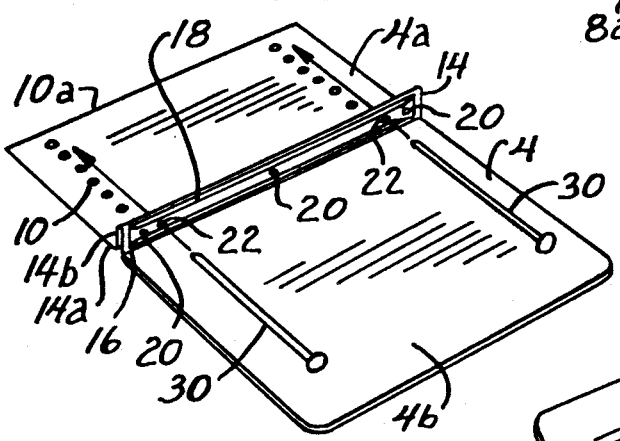
FIG. 2 is a perspective view of the inside surface of the back cover of the loose leaf binder of FIG. 1 in a flat configuration.

Referring now to FIGS. 1 to 6 there is illustrated the expandable loose leaf binder of the invention, generally designated by reference numeral 2. The expandable binder 2 includes a back cover member 4 having a flexible flap **4*a* and a front cover member 6. As seen in FIG. 1, the loose leaf binder 2 secures a plurality of sheets or leaves 8 with the back edge 8*a* being covered in all thicknesses by a flexible or pliant flap 4*a* of a plastic material forming the edge section. The back cover portion 4*b* is rigid in construction and may be covered with a plastic material in a conventional manner. The flexible flap 4*a* is provided with a plurality of apertures 10, such as eleven or similar number, disposed in two parallel rows extending along an axis perpendicular to the free end edge 10*a* of flap 4*a*. The flap 4*a* is integrally retained to the back cover 4*b* by a flexible section 14 folded in superimposed relationship in two portions 14*a* and 14*b* as best shown in FIG. 2. A metal strip 16 extending substantially the height of the cover is affixed to intermediate section 14*a*. The metal strip 16 includes a pair of raised edge portions 18 and is retained by three fastener elements 20 securing metal strip 16 and intermediate sections 14*a* and 14*b* in unitary superimposed configuration. The metal strip 16 and intermediate section 14 include a pair of insertion holes 22 being in alignment with the axis of the rows of apertures 10**.

Figure 6:
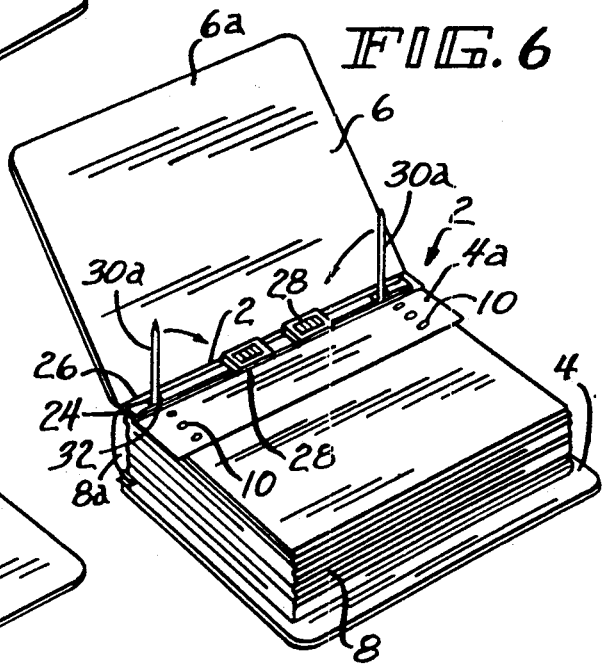
FIG. 6 is a top perspective view of the front cover being retained to the back cover as shown in the configuration of FIG. 5.

As shown in FIGS. 1 and 6, the front cover 6 includes a rigid cover portion **6*a* and a flexible inner edge flap 24 extending the height of the cover portion 6*a*. A metal strip 26 is retained by three fasteners (not shown) to retain the metal strip 26 to the flexible flap 24 as seen in FIG. 6. The metal strip includes rail like elements 26*a* which mount a pair of clips 28 in retained relationship for sliding movement along the spine 26. The clips 28 act to retain the exposed end portion 30*a* of plastic retainer elements 30** in a secured downward position beneath the clips (secured position not shown) in a conventional manner.

Figure 4:
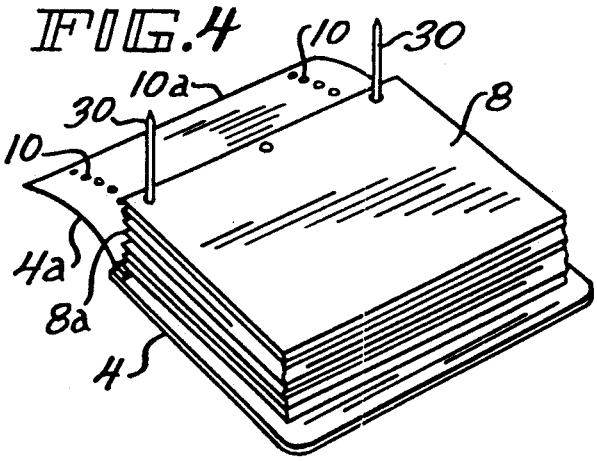
FIG. 4 is a top perspective view of the inside of the back cover of the loose leaf binder of FIG. 3 having a plurality of loose leaf sheets affixed to the spline of FIG. 3.
Figure 5:
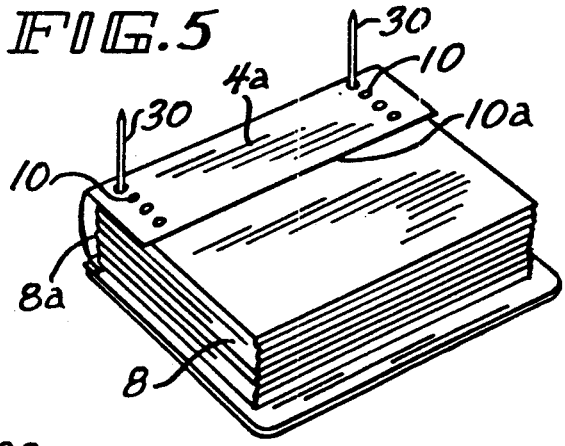
FIG. 5 is a top perspective view of the back cover of FIG. 5 in which the flap of the back cover is folded over in an adjusted position of the loose leaf sheets shown in FIG. 4.
Figure 3:
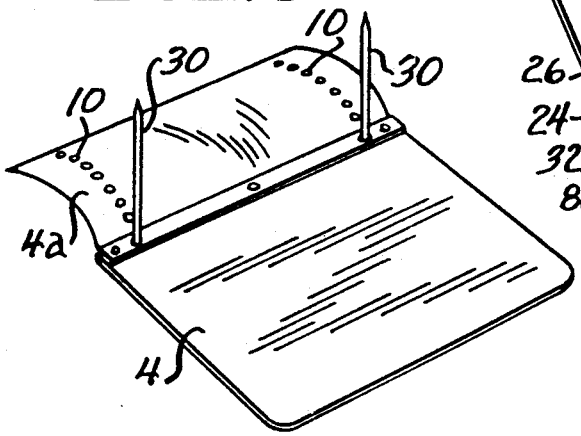
FIG. 3 is a top perspective illustration of the back cover having splines for retention of sheets being retained.

The technique for binding the loose leaf sheets in the variable width binder 2 is shown in FIGS. 2 to 6. As seen in FIG. 2, the retainer elements 30 are inserted through three punched holes 22 and are pulled up to a vertical position as depicted in FIG. 3. Sheets of prepunched paper 8 and the like are placed on posts 30 on the inside of back 4 as seen in FIG. 4. The flap **4*a* is then folded over, such that the posts 30 will pass through a pair of the apertures 10 that matches the width of the sheets 8 being retained. The cover 6 is then placed on the sheets through holes 32 within the metal strip 26 and flap 24. The exposed ends 30*a* of the posts 30 are bent inward and the tabs 28 are moved over the exposed ends 30*a* to secure the front cover 6 to the back cover 4*a*. When loading the sheets with leaves 30 being retained by posts 30 and it is anticipated that front pages will be added later, then page 1 is initially the top sheet of the sheets 8 as seen in FIG. 6. Alternatively, if back pages will be added later, the first sheet at the top of FIG. 6 would be the back pages so that additional back pages could be easily accommodated and realignment of a particular aperture 10 with the posts 30** is possible as additional thickness are added.

What is claimed is:

1. An expandable loose leaf binder for retaining a plurality of punched sheets comprising a first rigid cover member, a second rigid cover member including an edge portion, said second cover member having an integral pliant flap extending in attached relationship from said edge portion of said second rigid cover member, said pliant flap including a free edge and extending from said edge portion to said free edge, said pliant flap having an extent from said edge portion to said free edge greater than the thickness of the maximum number of punched sheets being retained, said pliant flap further having a plurality of rows of a plurality of separate apertures arranged in perpendicular relationship to said edge portion, and post means for retaining said plurality of sheets to said first and second rigid cover members, said post means having a plurality of post members arranged to be directed respectively through said first rigid cover member, through the plurality of punched sheets, and through aligned ones of said plurality of said apertures of each of said plurality of rows in accordance with the thickness of the plurality of the punched sheets.

2. The expandable loose leaf binder according to claim 1 wherein said pliant flap is retained to said second rigid cover member by a pliant intermediate connecting portion.

3. An expandable loose leaf binder for retaining a plurality of punched sheets comprising a first rigid cover member, a second rigid cover member including an edge portion, said second cover member having an integral pliant flap extending in attached relationship from said edge portion of said second rigid cover member, said pliant flap including a free edge and extending from said edge portion to said free edge, said pliant flap having an extent from said edge portion to said free edge greater than the thickness of the maximum number of punched sheets being retained, said pliant flap further having a plurality of rows of a plurality of separate apertures arranged in perpendicular relationship to said edge portion, post means for retaining said plurality of sheets to said first and second rigid cover members, said post means having a plurality of post members arranged to be directed respectively through said first rigid cover member, through the plurality of punched sheets, and through aligned ones of said plurality of said apertures of each of said plurality of rows in accordance with the thickness of the plurality of the punched sheets, wherein said pliant flap is retained to said second rigid cover member by a pliant intermediate connecting portion, and said pliant intermediate connecting section includes a pair of folded superimposed sections.

4. The expandable loose leaf binder according to claim 2 further including a rigid spine affixed to said pliant intermediate connecting section, said rigid spine and said intermediate connecting portion having holes for receiving said plurality of post members.

5. The expandable loose leaf binder according to claim 4 wherein said first rigid cover member includes a second pliable flap, said second pliable flap having a second rigid spine, said second rigid spine having holes for receiving said plurality of post members.

6. The expandable loose leaf binder according to claim 5 wherein said second rigid spine includes retention means for securing said post members.

7. An expandable loose leaf binder comprising first and second cover means for retaining a plurality of sheets, said second cover means having a flexible flap, said flexible flap being affixed at a first end portion to said second cover means and terminating with an opposite free end portion, said flap having a plurality of apertures arranged in rows disposed substantially between said first end and said free end, each of said rows of apertures including a plurality of separate aligned apertures, and post means for securing said plurality of sheets through selected ones of said plurality of apertures in accordance with thickness of the plurality of sheets.

* * * * *